United States Patent [19]

Sanders et al.

[11] Patent Number: 4,480,369

[45] Date of Patent: Nov. 6, 1984

[54] GRIPPING TOOL

[76] Inventors: Nicholas A. Sanders, 29 Kensington Rd., Madison, N.J. 07940; Daniel W. Sanders, 8685 Hastings St. Northeast, Blaine, Minn. 55434

[21] Appl. No.: 350,991

[22] Filed: Feb. 22, 1982

[51] Int. Cl.[3] ..... B25B 27/00

[52] U.S. Cl. ..... 29/270; 52/DIG. 1; 221/93; 221/279

[58] Field of Search ..... 29/270, 271, 272, 278, 29/280; 221/279, 267, 56, 92, 93, 221, 226; 52/DIG. 1

[56] References Cited

U.S. PATENT DOCUMENTS

| | | | |
|---|---|---|---|
| 2,253,885 | 8/1941 | Bregou | 221/93 X |
| 2,407,409 | 9/1946 | Farries | 221/279 X |
| 2,431,121 | 11/1947 | Hunter | 221/267 X |
| 2,438,642 | 3/1948 | Martin | 29/271 |
| 2,601,852 | 7/1952 | Wendt | 221/279 X |
| 3,669,310 | 6/1972 | Zackheim | 221/279 |
| 3,854,625 | 12/1974 | Kuebler | 221/279 X |
| 3,908,859 | 9/1975 | Hohmann | 221/279 X |
| 4,113,143 | 9/1978 | Spagnola, Jr. | 221/267 |
| 4,174,048 | 11/1979 | Volpe, Jr. | 221/279 X |
| 4,243,153 | 1/1981 | Mitchell | 221/279 X |

FOREIGN PATENT DOCUMENTS

| | | | |
|---|---|---|---|
| 272010 | 11/1950 | Switzerland | 221/267 |

*Primary Examiner*—Frederick R. Schmidt
*Assistant Examiner*—Steven P. Schad
*Attorney, Agent, or Firm*—Williamson, Bains, Moore & Hansen

[57] ABSTRACT

Stressing tendons used in prestressing concrete are generally anchored to the concrete by wedge plates which are embedded in the concrete. The anchorage is accomplished by the use of gripping wedges which are placed around the stressing tendons and into the wedge plates.

A gripping tool is provided which inserts and seats, in a single operation, gripping wedges. The tool is generally comprised of a holding and guiding piece and a sliding mechanism.

6 Claims, 6 Drawing Figures

GRIPPING TOOL

BACKGROUND OF THE INVENTION

The present invention relates to, but is not limited to the area of mechanical equipment and/or hand tools used in the construction of post-tensioned concrete structures.

Post-tensioning is a method of prestressing cast-in-place or precast concrete and may be divided into three categories or systems depending on whether the stressing tendons (tendon is herein taken to be the prestressing steel) are wire, strand, or bar.

Post-tensioned construction is classified as "bonded" or "unbonded" depending on whether the tendon ducts (ducts are the passages through which the tendons pass) are filled with a mortar grout after stressing (bonded), or whether the tendons are greased and paper wrapped, or greased and plastic covered (unbonded). Most systems of post-tensioning (whether wire, strand or bar) are adaptable to both bonded and unbonded construction techniques. For both bonded and unbonded construction the tendons are stressed by attaching hydraulic jacks, or the like to the ends of tendons and applying the correct amount of prestressing force.

Tendon anchorages, where anchorage is herein taken to be the means by which the prestressing force is permanently transmitted from the prestressing steel (tendon) to the concrete, vary somewhat between the system of post-tensioning.

An anchorage which is used in all systems of post-tensioning, but most extensively in the strand and bar systems, is the split wedge and wedge plate anchorage. It consists of a cast (or otherwise) wedge plate which is permanently embedded in the concrete. The tendon passes through the wedge plate and is gripped by a split conical wedge (usually two-piece) which is placed around the tendon and into a conical hole in the wedge plate. After the concrete has obtained the necessary strength, the tendon is stressed and the conical wedge grippers pressed into place around the tendon and into the conical hole in the wedge plate. This provides the anchorage. The wedge plate is totally embedded in the concrete. Block-outs are used when the concrete is poured so that there is excess to the conical hole in the wedge plate for gripping and stressing the tendon.

For construction purposes it is necessary to insert and lightly seat the conical wedge grippers, hereinafter grippers, around the tendon and into the conical hole in the wedge plate before attaching the stressing jack to the tendon. This inserting and seating of the grippers into the conical hole in the wedge plate is an object of the instant invention.

Heretofore, the method for inserting the grippers into the conical hole in the wedge plate has been to do so by hand. This has been complicated by the fact that the wedge plate is recessed into the concrete. Furthermore, as the grippers are put in by hand, they tend to be loose and may fall out of position before being seated. This procedure can thus become very tedious and cumbersome. Heretofore, the method used to seat the grippers has been to use a seating bar which fits over the tendon and can be slid along the tendon into the recessed area in the concrete to tap (or seat) the grippers into place.

SUMMARY OF THE INVENTION

It is an object of this invention to eliminate the problems and complications of the prior art by providing a means to insert and seat, in a single operation, the tendon grippers.

Towards this end, a device is provided which is comprised of a holding and guiding piece and a sliding mechanism. The holding and guiding piece performs the function of holding a set grippers along side a tendon, and in a position to be inserted. It also performs the function of guiding the grippers on to and around the tendon and into their final positions with the wedge plate.

The sliding mechanism preforms the function of sliding grippers from their positions in the holding and guiding piece into their final positions in the wedge plate. It also has the function of seating the grippers.

The holding and guiding piece is comprised of holding channels, guiding tracks, and a guiding ejector head. The holding channels hold the tendon grippers. The channels are positioned such that they allow the placement of the gripping tool over and around the tendon to be gripped. The number of holding channels depends on the number of grippers comprising a gripping set and the number of grippers from that set being placed in a single holding channel. For a split conical wedge, two grippers usually form a gripping set. For this type of gripping wedge two holding channels are used. Since the two-piece split conical wedge is by far the most widely used anchorage, the preferred embodiment will contain two holding channels. The holding channels may hold any number of gripping sets depending only upon their length.

The guiding tracks guide the grippers along the hold channels and up to the guiding ejector head. They are fixed in the holding channels in such a way that the grippers are supported in their correct positions while being moved along the holding channel.

The guiding ejector head guides the grippers from the holding channels on to the tendon and then along the tendon into their final positions in the wedge plate. As the grippers are moved out from their positions in the holding channels the leading edge of each gripper in the set of grippers is guided by the ejector nozzle on to the tendon. Once on the tendon the grippers are guided both by the tendon and the guiding ejector head into the wedge plate.

The sliding mechanism forces the grippers to slide. It is placed behind the last set of grippers. When moved, the sliding mechanism moves the entire string of sets in the holding channels, forcing the first set to be guided on to the tendon and into the wedge plate as previously described. The sliding mechanism can be powered by any convenient means. For the preferred embodiment it is powered by hand.

The gripping tool can be held by any convenient means. For the preferred embodiment it is held by a handle attached to the sliding mechanism. These and other objects of our invention will become readily apparent as the following description is read in conjunction with the accompanying drawings.

DESCRIPTION OF THE DRAWING FIGURES

DESCRIPTION OF THE PREFERRED EMBODIMENT

Figures 1, 2, 3, 4:
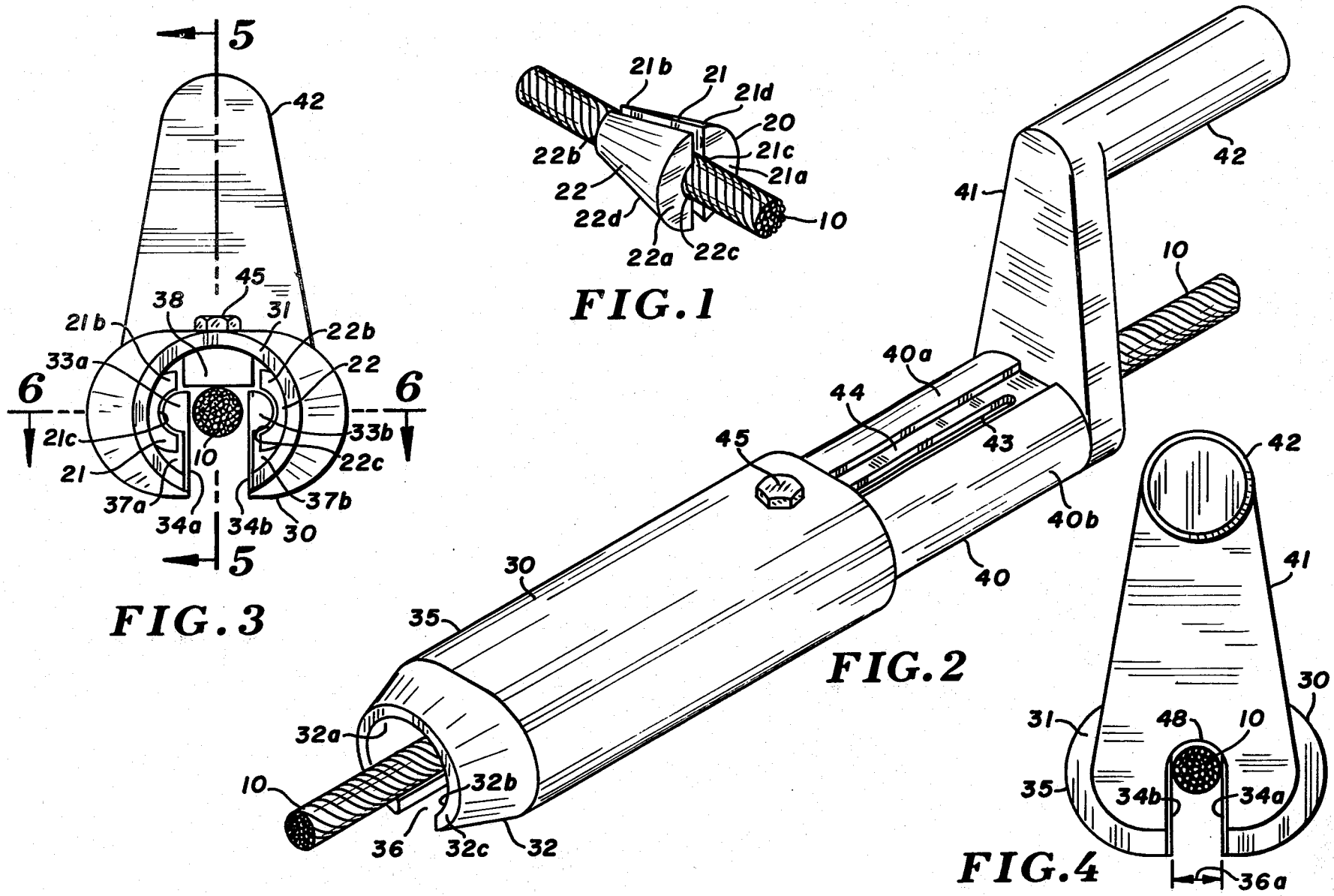
FIG. 1 is a perspective view of a set of grippers placed in their proper positions around a tendon.
FIG. 2 is a perspective view of the instant invention placed in its working position over a tendon.
FIG. 3 is a frontal view of the instant invention placed in its working position over a tendon.
FIG. 4 is a back view of the instant invention placed in its working position over a tendon.

Gripping tool 30 is generally comprised of the holding and guiding piece 35 and the sliding mechanism 40.

Grippers 21 and 22 of the set of grippers 20 are respectively placed in holding channels 37*a* and 37*b*, a multiple of sets 20 can be placed in the said holding channels. The number of grippers 21 and 22 which can be held by their respective holding channels 37*a* and 37*b* is determined by the length of the holding channels 50, which is equal for both channels 37*a* and 37*b*. For the preferred embodiment the holding channels 37*a* and 37*b* form an integral part of holding and guiding piece 35. They are positioned in such a way that gripping tool 30 can be placed over and around stressing tendon 10. This is accomplished by allowing opening 36, of sufficient width 36*a*, to extend the entire length of said piece 35. Positioning stop 38 of said piece 35 and positioning stop 48 of sliding mechanisms 40 align gripping tool 30 on tendon 10. Gripping tool 30 is aligned such that the center of guiding tracks 33*a* and 33*b* are aligned with the center of tendon 10. Guiding tracks 33*a* and 33*b* are shaped such that they fit the curved surfaces 21*c* and 22*c* of grippers 21 and 22 respectfully. Pieces 34*a* and 34*b* support tracks 33*a* and 33*b* respectively and form an integral part of the holding and guiding piece 35. Although for the preferred embodiment holding channels 37*a* and 37*b* are made an integral part of holding and guiding piece 35, in general they can be in whole or in part detachable allowing them to then serve as refillable magazines.

The guiding ejector head 32 is an integral part of said holding and guiding piece 35. Tapered surfaces 32*a* and 32*b* of ejector head 32 serve as means to guide grippers 21 and 22, respectively, from their position in the holding channels on to tendon 10 and out the ejector nozzle 32*c*.

Sliding mechanism 40 is inserted into end 31 of holding and guiding piece 35. Slides 40*a* and 40*b* are fitted into holding channels 37*a* and 37*b* respectively. Guiding groove 44 of sliding mechanism 40 fits into guide 39 of holding and guiding piece 35. Said sliding mechanism 40 is held into said holding and guiding piece 35 by slot screw 45 set into slot 43.

For the preferred embodiment sliding mechanism 40 is actuated manually by handle 42 fixed to sliding mechanism 40 via piece 41. Handle 42 also serves as a means to hold gripping tool 30. Although for the preferred embodiment sliding mechanism 40 is manually actuated, any convience means by which sliding mechanism 40 can be caused to move relative to holding and guiding piece 35 may be employed. For example a fluid or an electrical means for actuating. Furthermore, although for the preferred embodiment handle 42 serves as a means to hold gripping tool 30 any convient means of holding said tool may be employed.

OPERATION OF THE PREFERRED EMBODIMENT

The preferred embodiment will preform and meet the functions and objectives of the instant invention when operated in the following manner.

Figure 5:
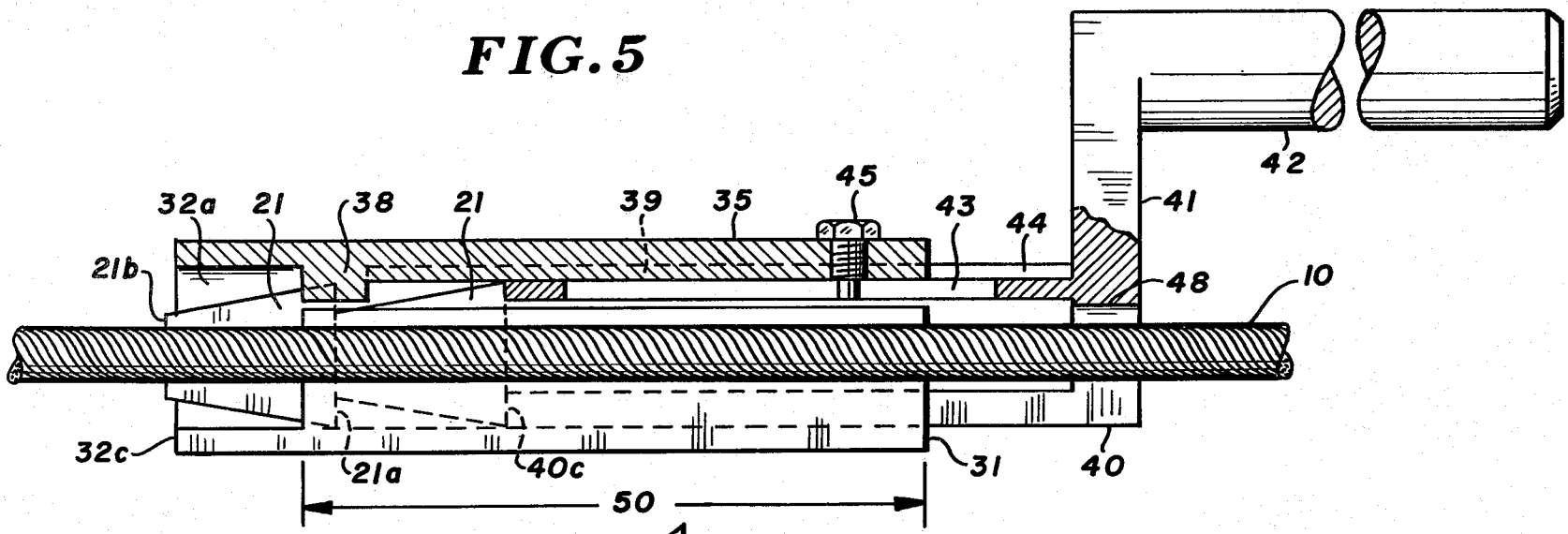
FIG. 5 is a sectional view taken along lines 5—5 of FIG. 3.
Figure 6:
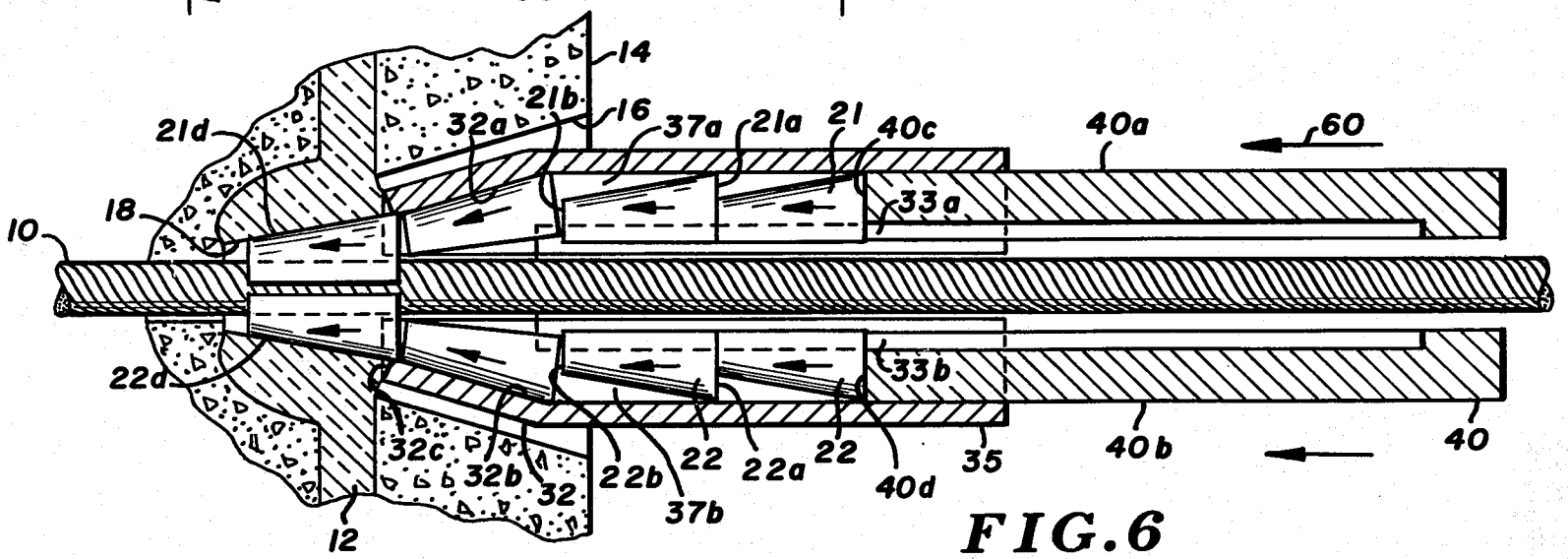
FIG. 6 is a sectional view taken along lines 6—6 of FIG. 3, showing the insertion of a set of grippers.

Prior to operating gripping tool 30, said tool must be loaded with an integral number of gripping sets 20. The style, exact shape, and number of grippers compressing a gripping set is in general arbitrary and no attempt is made herein to limit the use of the instant invention to one style, shape or number of grippers. For the preferred embodiment gripping set 20 is comprised of grippers 21 and 22. To load gripping tool 30, sliding mechanism 40 should be fully retracted, such that surfaces 40*c* and 40*d* of slides 40*a* and 40*b*, respectively, are as close as possible to end 31 and holding channels 37*a* and 37*b* are fully extended. Holding gripping tool 30 in a convenient way, a number of gripping sets 20 may be placed one gripping set 20 at a time in to the said tool 30 by first placing a gripper 21 into holding channel 37*a* and then a gripper 22 into holding channel 37*b*. Grippers 21 and 22 are passed through ejector nozzle 32*c* and into their respective holding channels such that surfaces 21*a* and 22*a*, respectively, are facing end 31 as shown in FIGS. 5 and 6. For the first set of grippers 20 loaded, the surfaces 21*a* and 22*a* of grippers 21 and 22, respectively, will be in contact with surfaces 40*c* and 40*d* of slides 40*a* and 40*b*, respectively. For subsequent sets 20, surfaces 21*a* and 22*a* of grippers 21 and 22, respectively, will be in contact with surfaces 21*b* and 22*b* of the previous grippers 21 and 22, respectively. The process of loading will continue until the desired number of gripping sets (each set being comprised of grippers 21 and 22) are loaded.

Gripping tool 30 is operated by placing it over tendon 10, as shown in FIG. 2, and sliding said tool 30 along said tendon 10 into recessed area 16 of concrete slab 14, shown in FIG. 6. At some point ejector nozzle 32*c* will come in contact with the outer rim of conical hold 18 of wedge plate 12. Further motion 60 of sliding mechanism 40 relative to holding and guiding piece 35 results in the insertion of a gripping set 20 (Herein, insert or insertion is taken to mean the act of moving a gripping set from its storage position within the gripping tool on to and around a tendon and into its final position in a wedge plate) as shown in FIG. 6.

The seating (herein seat or seating is taken to mean the act of fixing in place) of grippers 21 and 22 of gripping set 20 is accomplished by a change in momentum caused by motion 60 when edges 21*d* and 22*d* of grippers 21 annd 22, respectively, come in contact with conical hole 18.

It is contemplated that various changes and/or modifications may be made to the gripping tool without departing from the spirit and scope of our invention as defined by the following claims.

We claim:

1. A gripping tool for inserting a gripper set into a wedge plate, said tool comprising:

a body comprising:

a first holding channel containing therein at least a first tendon gripper;

a second holding channel containing therein at least a second tendon gripper;

a slot extending the full length of said tool and sized to accommodate a tendon therein exclusive of said tool, said slot adjoiningly positioned between said channels, said slot being open along its entire length so as to allow said tool to be straddlingly placed on a tendon;

means for guiding a gripper from each said holding channel onto a tendon and into a wedge plate to form a gripper set; and means for simultaneously ejecting a gripper from each said holding channel through said guide means into cooperative relationship with one another and a tendon.

2. The gripping tool of claim 1 wherein said passage comprises an open slot extending between said channels and through said guide means.

3. The gripping tool of claim 1 wherein each said holding channel comprises first and second ends and said guide means comprises first and second ends.

4. The gripping tool of claim 3 wherein said guide means first end contiguously communicates with said holding channel first ends and said guide means second end is sized to smoothly communicate with the outer end of a wedge plate.

5. The gripping tool of claim 1 wherein said ejecting means comprises:

a first slide portion slidably located in said first holding channel; and a second slide portion located in said second holding channel, said slides being connected for simultaneous operation and spaced apart to allow passage of a tendon therebetween.

6. The gripping tool of claim 1 wherein said first channel holds a first plurality of grippers in end-to-end relationship and wherein said second channel holds a second plurality of grippers in end-to-end relationship.

* * * * *